US006568988B1

(12) United States Patent
Chin et al.

(10) Patent No.: US 6,568,988 B1
(45) Date of Patent: May 27, 2003

(54) CHEMICAL MECHANICAL POLISHING APPARATUS WITH STABLE SIGNALS

(75) Inventors: Yi-Hua Chin, Taipei (TW); Hua-Jen Tseng, Chu-Pei (TW); Chun-Chieh Lee, Hsinchu Hsien (TW); Dong-Tay Tsai, Kaohsiung (TW)

(73) Assignee: Mosel Vitelic Inc., Hsinchu (TW)

( * ) Notice: Subject to any disclaimer, the term of this patent is extended or adjusted under 35 U.S.C. 154(b) by 274 days.

(21) Appl. No.: 09/628,138

(22) Filed: Jul. 28, 2000

(30) Foreign Application Priority Data

Sep. 3, 1999 (TW) ..... 88115197 A

(51) Int. Cl.[7] ..... B24B 49/00; B24B 51/00
(52) U.S. Cl. ..... 451/1; 451/5; 451/288
(58) Field of Search ..... 451/1, 5, 8, 9, 451/285–290

(56) References Cited

U.S. PATENT DOCUMENTS 5,904,609 A * 5/1999 Fukuroda et al. ..... 451/285

* cited by examiner

*Primary Examiner*—Timothy V. Eley
(74) *Attorney, Agent, or Firm*—Intellectual Property Solutions Incorporated

(57) ABSTRACT

A chemical mechanical polishing apparatus has a plurality of electric machines for executing mechanical polishing motions, at least two control systems for controlling the mechanical polishing motions, at least two signal wires connected with the two control systems for transmitting signals of the two control systems, and a wave filter comprising two terminals connected with the two signal wires respectively for filtering out the signal whose voltage exceeds a predetermined value in the two signal wires.

10 Claims, 4 Drawing Sheets

CHEMICAL MECHANICAL POLISHING APPARATUS WITH STABLE SIGNALS

BACKGROUND OF THE INVENTION

1. Field of the Invention

The present invention relates to a chemical mechanical polishing (CMP) apparatus, more particularly, to a chemical mechanical polishing apparatus with stable signals.

2. Description of the Prior Art

Currently, a chemical mechanical polishing (CMP) process is often used as a planization process in the semiconductor processing. Please refer to FIG. 1. FIG. 1 is a schematic diagram of a CMP apparatus 10 according to the prior art. The CMP apparatus 10 comprises a plurality of electric machines 12 that probably have motors and vacuum pumps for executing the CMP motion. Generally, the plurality of electric machines 12 comprises an automatic device 13 for conveying semiconductor wafers to a predetermined place, a multi-head polishing device 15 for polishing the semiconductor wafers, and a mainframe (not shown) for executing the provision of slurry and the drainage of waste water. The CMP apparatus 10 further comprises at least two control systems for controlling and coordinating the motions of the electric machines 12. As shown in FIG. 1, three control systems 14 are connected to the automatic device 13, the multi-head polishing device 15 and the mainframe respectively, wherein two adjacent control systems 14 are connected by two signal wires 16. Since the signals of the two signal wires 16 comply with RS422 communication protocol, each step in CMP process can be accurately connected with the next step.

However, in practical operation, the CMP apparatus 10 always has a breakdown or shutdown. In accordance with the information shown on a monitor (not shown), it is well known that the disconnection of the control systems 14 causes the discordance between the electric machines 12 and the shutdown of the CMP apparatus 10. Also, it will lead to over-polished semiconductor wafers and contamination on the pad and carrier during the CMP process. Furthermore, when the CMP apparatus 10 is idle, it will stop executing a wet mode and thereby dry the pad and carrier. Both of cleaning and replacing the pad and carrier are troublesome and expensive.

In order to solve the above-mentioned problems, many methods are undertaken such as changing the software on the power cord of the control systems 14, using new signal wires 16 and new terminals, adjusting the rate of transmitting the signals and exchanging a control system 14. Nevertheless, the disconnection between the control systems 14 always occurs.

SUMMARY OF THE INVENTION

The object of the present invention is a chemical mechanical polishing apparatus with stable signals to solve the above-mentioned problems.

To achieve the above-mentioned object, the chemical mechanical polishing apparatus comprises a plurality of electric machines, at least two control systems, at least two signal wires, and a wave filter. The electric machines are used to execute mechanical polishing motions. The control systems are used to control the mechanical polishing motions. The two signal wires are connected with the two control systems for transmitting signals of the two control systems, wherein the signals comply with RS422 communication protocol to coordinate the mechanical polishing motions. The wave filter comprises two terminals connected with the two signal wires respectively for filtering out the signal whose voltage exceeds a predetermined value in the two signal wires.

It is an advantage of the present invention that the chemical mechanical polishing apparatus can eliminate the noise of the two signal wires so as to provide a stable connection.

This and other objective of the present invention will no doubt become obvious to those of ordinary skill in the art after having read the following detailed description of the preferred embodiment which is illustrated in the various figures and drawings.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
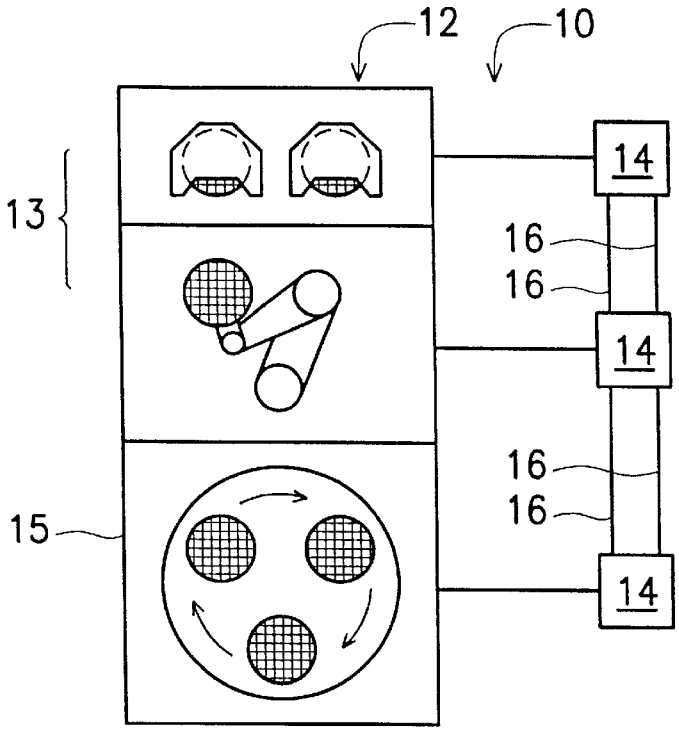
FIG. 1 (PRIOR ART)
FIG. 1 is a schematic diagram of a CMP apparatus according to the prior art.
Figure 2:
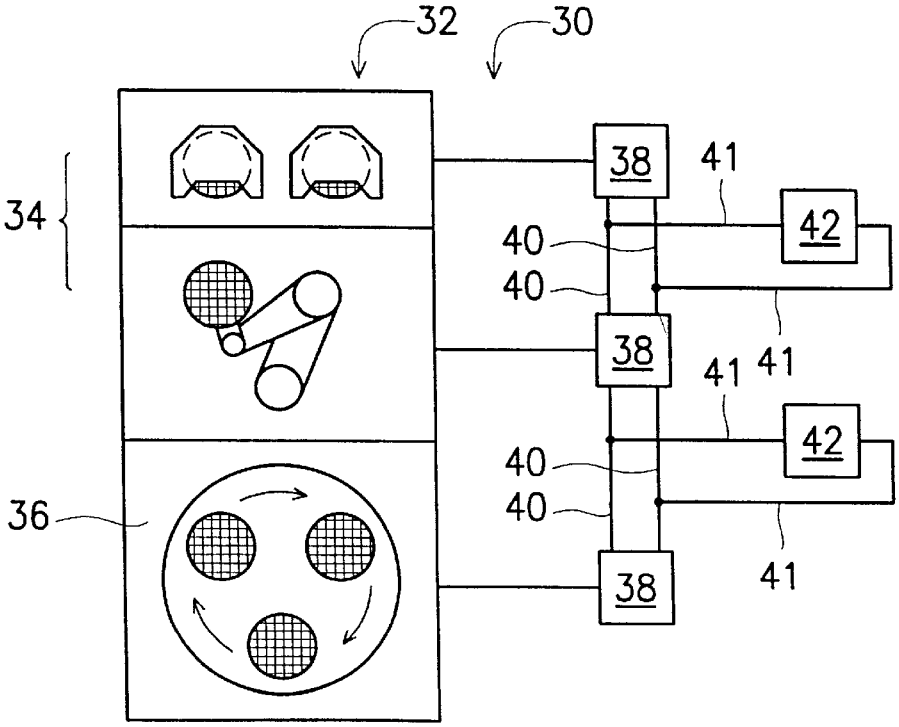
FIG. 2 is a schematic diagram of a chemical mechanical polishing apparatus according to the present invention.

Please refer to FIG. 2. FIG. 2 is a schematic diagram of a chemical mechanical polishing apparatus 30 according to the present invention. A chemical mechanical polishing (CMP) apparatus 30 of the present invention comprises a plurality of electric machines 32 for executing mechanical polishing motions, at least two control systems 38 for controlling the mechanical polishing motions, at least two signal wires 40 for transmitting signals of the control systems 38, and a wave filter 42 for filtering out the signal whose voltage exceeds a predetermined value in the two signal wires 40.

The plurality of electric machines 32 comprises an automatic device 34 for conveying a plurality of semiconductor wafers (not shown) to a predetermined place, a multi-head polishing device 36 for polishing the plurality of semiconductor wafers, and a mainframe (not shown) for executing the provision of slurry and the drainage of waste water. Thereby, there are three control systems 38 for controlling the automatic device 34, the multi-head polishing device 36 and the mainframe respectively.

The CMP apparatus 30 comprises two pairs of signal wires 40, 41, wherein the first pair of signal wires 40 connect two adjacent control systems 38 and the signals of the first pair of signal wires 40 comply with RS422 communication protocol to coordinate the mechanical polishing motions. The CMP apparatus 30 comprises two wave filters 42. Each filter 42 has two terminals connected with the second pair of signal wires 41 respectively for filtering out the signal whose voltage exceeds a predetermined value in the first pair of signal wires 40.

Figure 3:
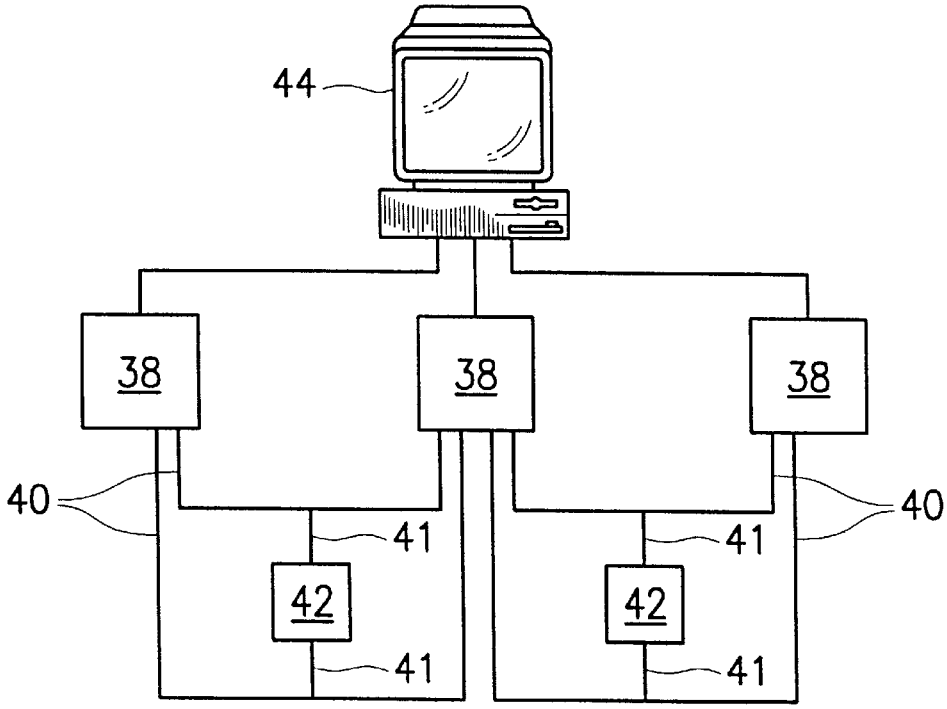
FIG. 3 is a schematic diagram of the control systems shown in FIG. 2 connected with a monitor.

Please refer to FIG. 3. FIG. 3 is a schematic diagram of the control systems 38 shown in FIG. 2 connected with a monitor 44. The CMP apparatus 30 further comprises a monitor 44 for displaying the status of all control systems 38. The communication protocol between the control systems 38 and the monitor 44 is RS232.

Figure 4A:
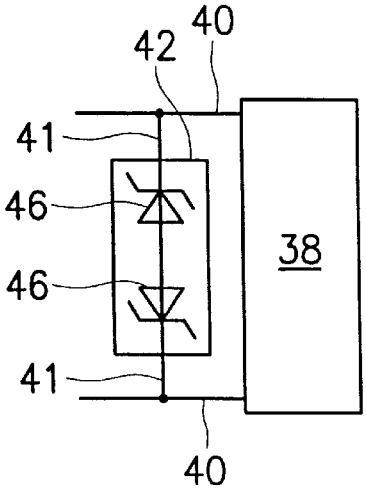
FIG. 4*a* and FIG. 4*b* are schematic diagrams of executing the wave filter shown in FIG. 2.
Figure 4B:
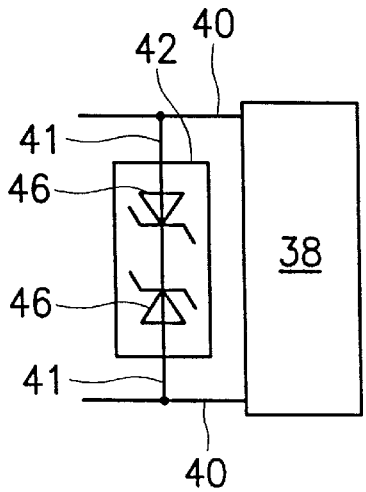

Please refer to FIG. 4*a* and FIG. 4*b*. FIG. 4*a* and FIG. 4*b* are schematic diagrams of executing the wave filter 42 shown in FIG. 2. There are many methods to make the wave filter 42 filtering out the signal of the signal wire 40 without expected voltage. In the preferred embodiment of the present invention, the wave filter 42 is made by two zenzer diodes 46. Each of the two zenzer diodes 46 comprises a positive electrode and a negative electrode. If the two zenzer diodes 46 connect by the two positive electrodes as shown in FIG. 4*a*, the two negative electrodes becomes the two terminals of the wave filter 42 and connect the first pair of signal wires 40 through the second pair of signal wires 41 respectively. On the contrary, If the two zenzer diodes 46 connect by the two negative electrodes as shown in FIG. 4*b*, the two positive electrodes becomes the two terminals of the wave filter 42 and connect the first pair of signal wires 40 through the second pair of signal wires 41 respectively. When the min breakdown voltage of the zenzer diode 46 is 4.3V, the wave filter 42 can filter out the signal whose voltage exceeds±5V in the first pair of signal wires 40. This can limit the signal margin of the signal wire 40 to prevent any irregular over-shoot wave, and thereby ensure that the control systems 38 receive correct signals.

Figure 5A:
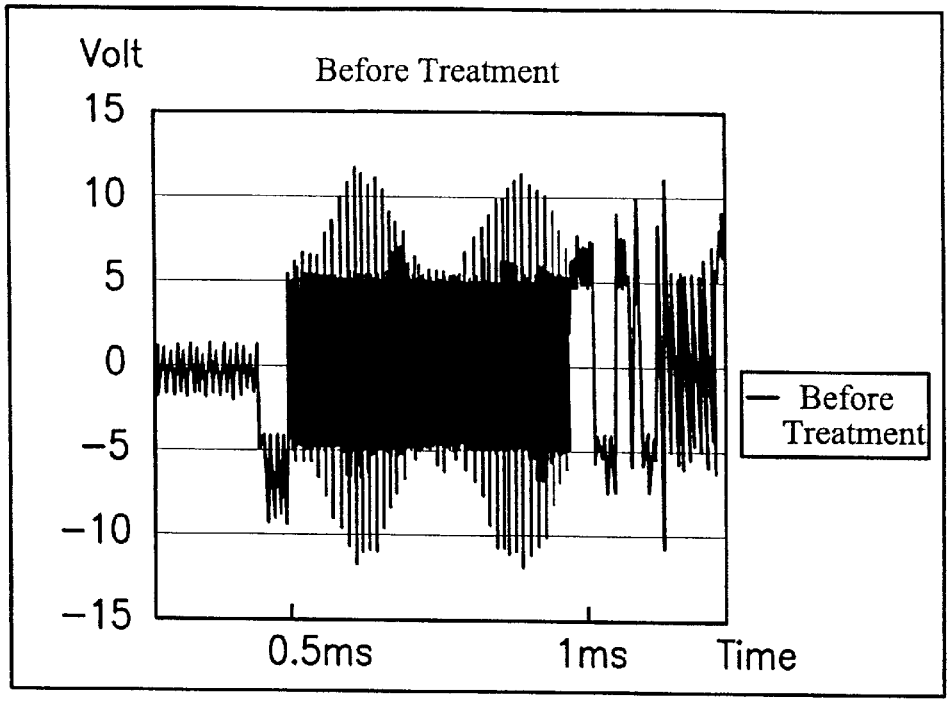
FIG. 5a (PRIOR ART)
FIG. 5*a* to FIG. 5*b* are signal diagrams according to the prior art.
Figure 5B:
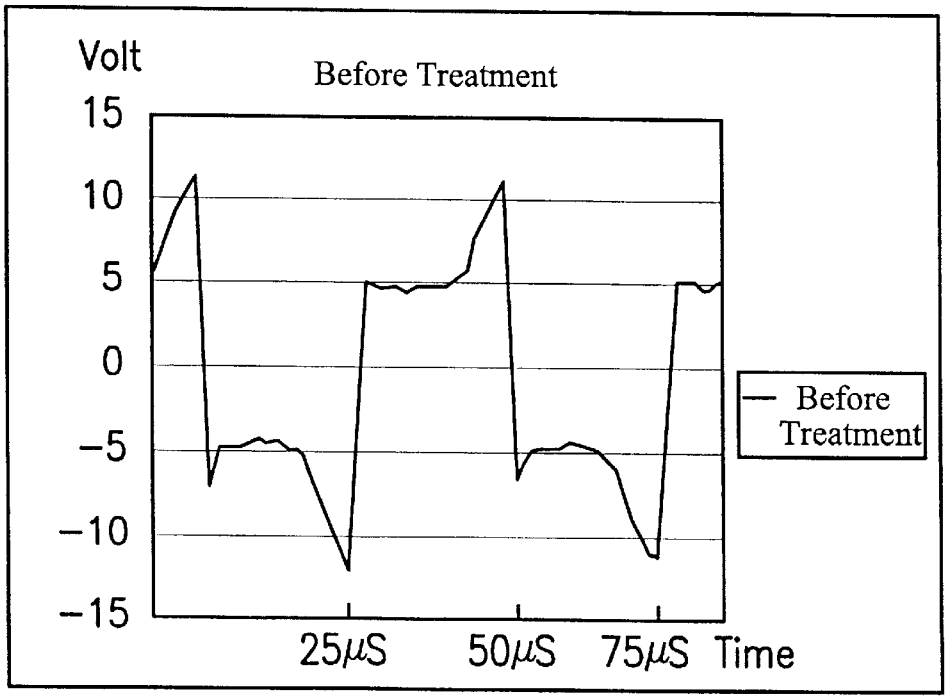
FIG. 5b (PRIOR ART)
Figure 5C:
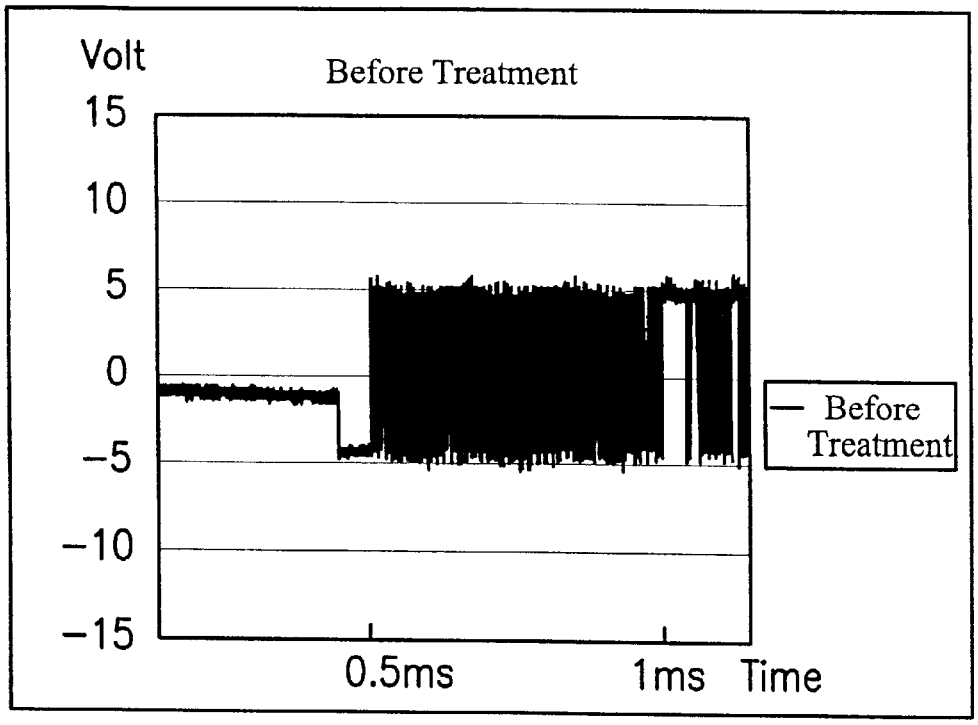
FIG. 5*c* to FIG. 5*d* are signal diagrams according to the present invention.
Figure 5D:
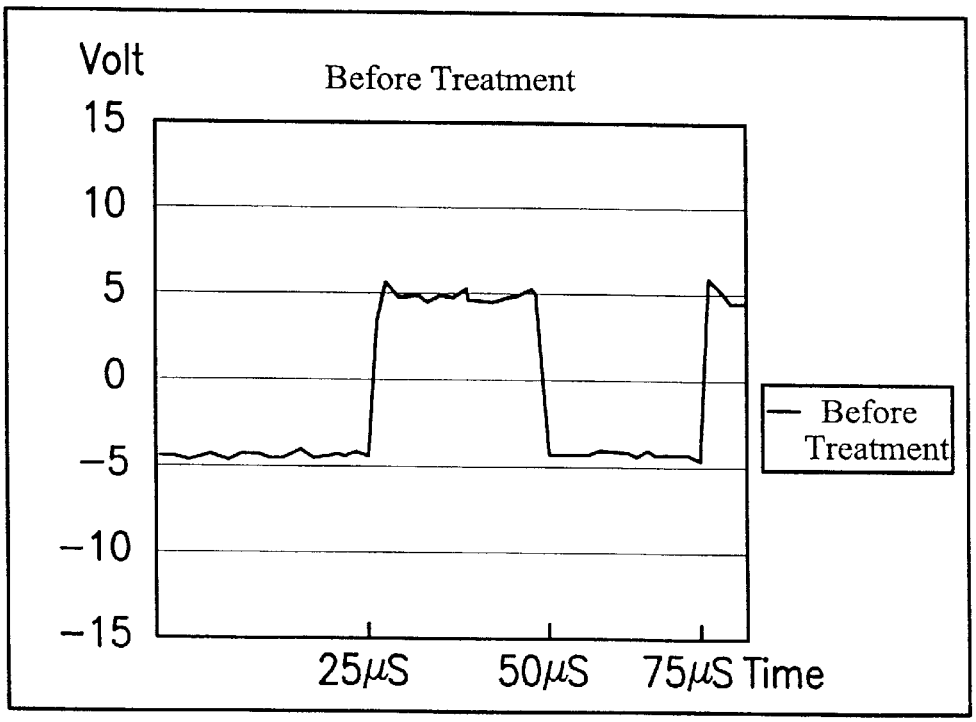

Please refer to FIG. 5*a* to FIG. 5*d*. FIG. 5*a* to FIG. 5*b* are signal diagrams according to the prior art. FIG. 5*c* to FIG. 5*d* are signal diagrams according to the present invention. As shown in FIG. 5*a* (during a long time) and FIG. 5*b* (during a short time), many over-shoot waves are found on the signal diagrams and the peak value of some over-shoot waves reaches ±10V that is twice the predetermined value (±5V). This phenomenon is regarded as a chief reason for the disconnection between the control systems in the prior art. As shown in FIG. 5*c* (during a long time) and FIG. 5*d* (during a short time), since the wave filters 42 of the CMP apparatus 30 filter out the signals with over-±5V voltage, no over-shoot wave is found and all the waveforms are more regular on the signal diagrams.

Compared to the prior art of the CMP apparatus 10, in the CMP apparatus 30 of the present invention, the wave filter 42 is installed between the first pair of signal wires 40 to filter out the signal whose voltage exceeds the predetermined value. This is can eliminate the over-shoot waves shown on the signal diagram and stabilize all signals. Consequently, the coordination of the two control systems 38 is controlled stably and each step of the CMP motions is accurately connected to the next step.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A chemical mechanical polishing (CMP) apparatus with stable signals, comprising:

a plurality of electric machines for executing mechanical polishing motions;

at least two control systems for controlling the mechanical polishing motions;

at least two signal wires connected with the two control systems for transmitting signals of the two control systems, wherein the signals comply with RS422 communication protocol to coordinate the mechanical polishing motions; and a wave filter comprising two terminals connected with the at least two signal wires respectively for filtering out any signal whose voltage exceeds a predetermined value in the two signal wires.

2. The apparatus of claim 1, wherein the wave filter is made of two zenzer diodes.

3. The apparatus of claim 2, wherein each zenzer diode comprises a positive electrode and a negative electrode, in which the positive electrodes of the two zenzer diodes are connected, and the negative electrodes of the two zenzer diodes serve as two terminals of the wave filter.

4. The apparatus of claim 2, wherein each zenzer diode comprises a positive electrode and a negative electrode, in which the negative electrodes of the two zenzer diodes are connected, and the positive electrodes of the two zenzer diodes serve as two terminals of the wave filter.

5. The apparatus of claim 2, wherein a breakdown voltage of each zenzer diode is 4.3V.

6. The apparatus of claim 1, wherein the wave filter is used to filter out any signal whose voltage exceeds ±5V in the two signal wires.

7. The apparatus of claim 1, further comprising a monitor for displaying the status of the two control systems.

8. The apparatus of claim 7, wherein the monitor and the two control systems comply with RS232 communication protocol.

9. The apparatus of claim 1, wherein the plurality of electric machines comprises:

an automatic device for conveying a plurality of semiconductor wafers to a predetermined place;

a multi-head polishing device for polishing the plurality of semiconductor wafers; and a mainframe for executing the provision of slurry and the drainage of waste water.

10. The apparatus of claim 9, wherein the at least two control systems comprise three control systems for controlling the motions of the automatic device, the multi-head polishing device and the mainframe respectively; and the at least two signal wires comprise:

a first pair of signal wires connecting two adjacent control systems for coordinating the motions of the plurality of electric machines; and a second pair of signal wires connected between the first pair of signal wires and the two terminals of the wave filter.

* * * * *